US006109961A

United States Patent [19]

Chen et al.

[11] Patent Number: 6,109,961

[45] Date of Patent: Aug. 29, 2000

[54] BOARD LOCK

[75] Inventors: Spencer Chen, Buena Park, Calif.; Thomas R. L. Tsai, Tu-Chen, Taiwan

[73] Assignee: Hon Hai Precision Ind. Co., Ltd., Taipei Hsien, Taiwan

[21] Appl. No.: 09/339,471

[22] Filed: Jun. 23, 1999

[30] Foreign Application Priority Data

Nov. 3, 1998 [TW] Taiwan ..... 87218242

[51] Int. Cl.[7] ..... H01R 13/73

[52] U.S. Cl. ..... 439/567

[58] Field of Search ..... 439/567, 571–573

[56] References Cited

U.S. PATENT DOCUMENTS 4,865,555 9/1989 Assini et al. ..... 439/567

5,407,364 4/1995 Tzeng et al. ..... 439/567

5,593,307 1/1997 Bale et al. ..... 439/567

5,738,541 4/1998 Tseng ..... 439/567

*Primary Examiner*—Gary F. Paumen

*Attorney, Agent, or Firm*—Wei Te Chung

[57] ABSTRACT

A board lock includes a base section fixed to an electrical device, such as a connector, and an elastically diameter-contractible barrel section extending from the base section beyond a face of the electrical device. The barrel has an external threading. The barrel has a section of nominal diameter substantially equal to or greater than an inner diameter of a hole defined in a circuit board whereby the barrel is elastically contractible to be inserted into the hole which generates a spring-back force driving the external threading to engage with the inner diameter thereby securing the electrical device to the substrate.

10 Claims, 4 Drawing Sheets

BOARD LOCK

BACKGROUND OF THE INVENTION

1. Field of the Invention

The present invention generally relates to a board lock for securing an electrical device, such as a connector, to a substrate, and in particular to a universal board lock which is capable of securing an electrical device to substrates of different thicknesses.

2. The Prior Art

An electrical circuit usually comprises a printed circuit board on which a plurality of electrical elements and devices are mounted. Some of the electrical elements are fixed to the circuit board by means of external fasteners or board locks before being soldered to the circuit board. Examples of board locks are shown in Taiwan Patent Application Nos. 83112290 and 84101384.

The conventional board locks comprise a plate-like base from which two resilient legs extend. The legs have barbs formed on free ends thereof opposite each other whereby when the legs are inserted into a hole defined in a substrate, the barbs extend beyond a bottom surface of the substrate and engage therewith.

FIG. 1A of the attached drawings shows a conventional board lock 50. The board lock 50 comprises an enlarged plate-like base section 51 from which two resilient legs 52 extend. Each resilient leg 52 has a barb 53 formed on a free end thereof. The board lock 50 is received in a bore 71 defined in an electrical device 70, such as a connector, whereby the base section 51 is supported on a shoulder 72 of the device 70 and the legs 52 extend through a narrow section of the bore 71.

The legs 52 are received in a hole 61 defined in a circuit board 60. The free ends of the legs 52 extend through the hole 61 and the barbs 53 engage with a bottom surface of the circuit board 60 thereby securing the electrical connector 70 to the circuit board 60.

The securement of the electrical connector 70 to the circuit board 60 is basically provided by the engagement between the barbs 53 and the bottom surface of the circuit board 60. This implies that the axial dimension of the legs 52 has to substantially correspond to the thickness of the circuit board 60 in order to ensure an effective securement of the electrical connector 70 to the circuit board 60.

As shown in FIG. 1B, if the legs 52 have a length substantially greater than the thickness of a circuit board 60' and extend through a hole 61' defined in the circuit board 60', then a distance exists between the barbs 53 and the bottom surface of the circuit board 60'. This distance prevents the barbs 53 from securely engaging with the bottom surface of the circuit board 60' and the connector 70 is not soundly secured on the circuit board 60'.

Therefore, a disadvantage associated with such a conventional design is that different board locks must be used for circuit boards having different thicknesses.

It is thus desirable to have a universal board lock which allows an electrical device to be effectively secured to substrates of different thicknesses.

SUMMARY OF THE INVENTION

Accordingly, an object of the present invention is to provide a board lock which is capable of mounting an electrical device to circuit boards of different thicknesses.

Another object of the present invention is to provide a board lock which is capable of engaging with a substrate through holes of different diameters defined therein.

A further object of the present invention is to provide an electrical connection device which comprises an electrical connector secured to a circuit board by means of the board lock described above.

To achieve the above objects, a board lock in accordance with the present invention comprises a base section fixed to an electrical device, such as a connector, and an elastically diameter-contractible barrel section extending from the base section beyond a face of the electrical device. The barrel has an external threading. The barrel has a section of nominal diameter substantially equal to or greater than an inner diameter of a hole defined in a circuit board whereby the barrel is elastically contractible to be inserted into the hole which generates a spring-back force driving the external threading to engage the inner diameter thereby securing the electrical device to the substrate.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1B:
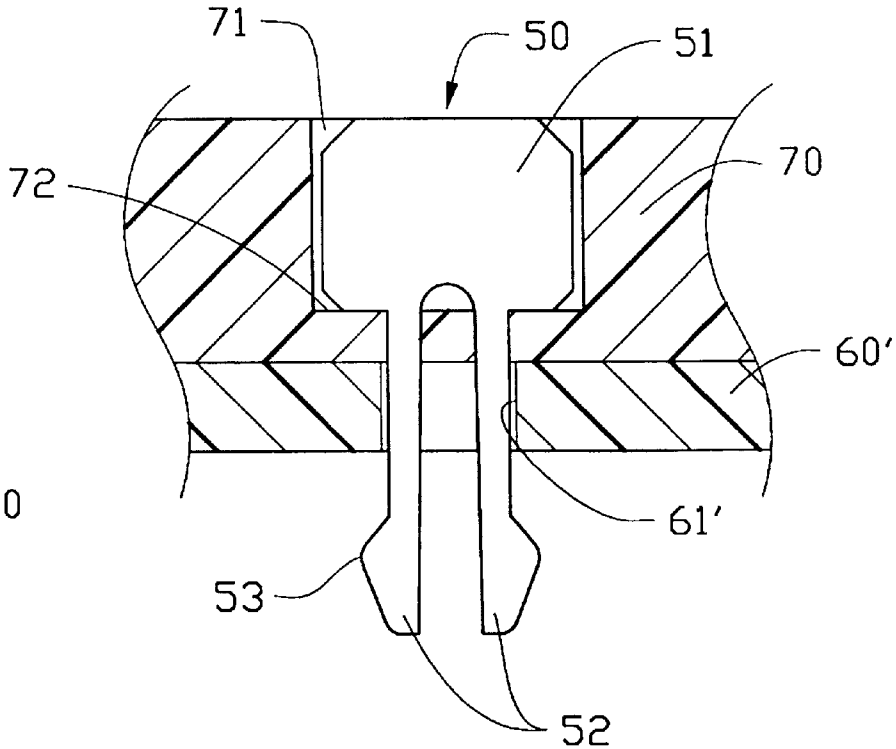
FIG. 1B is similar to FIG 1A wherein the board lock secures the electrical device to a substrate of different thickness.
Figure 1A:
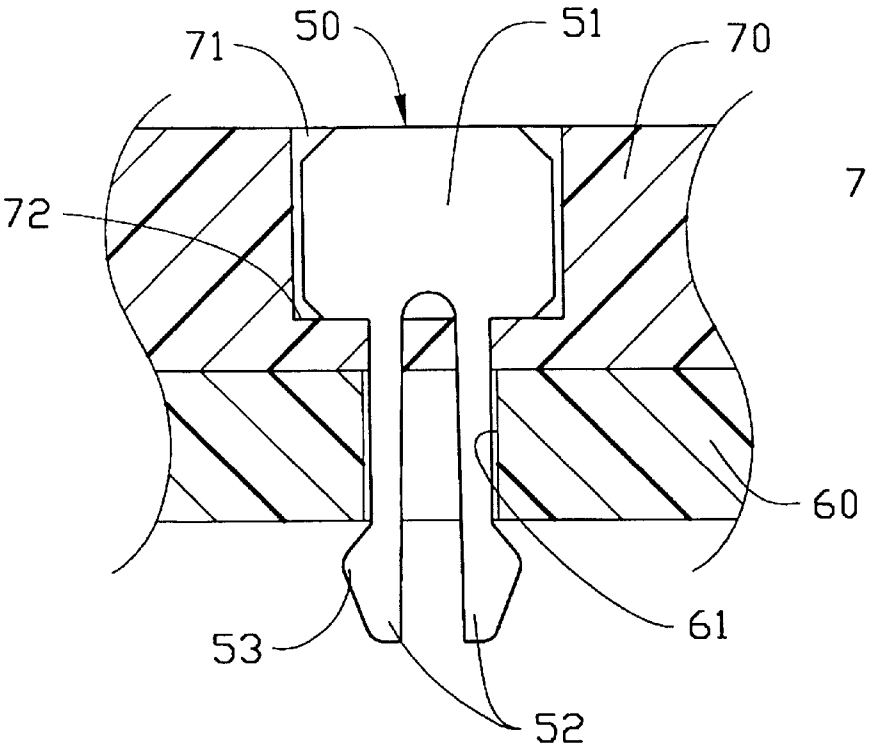
FIG. 1A is a cross-sectional view of a conventional board lock securing an electrical device to a substrate.
Figure 2:
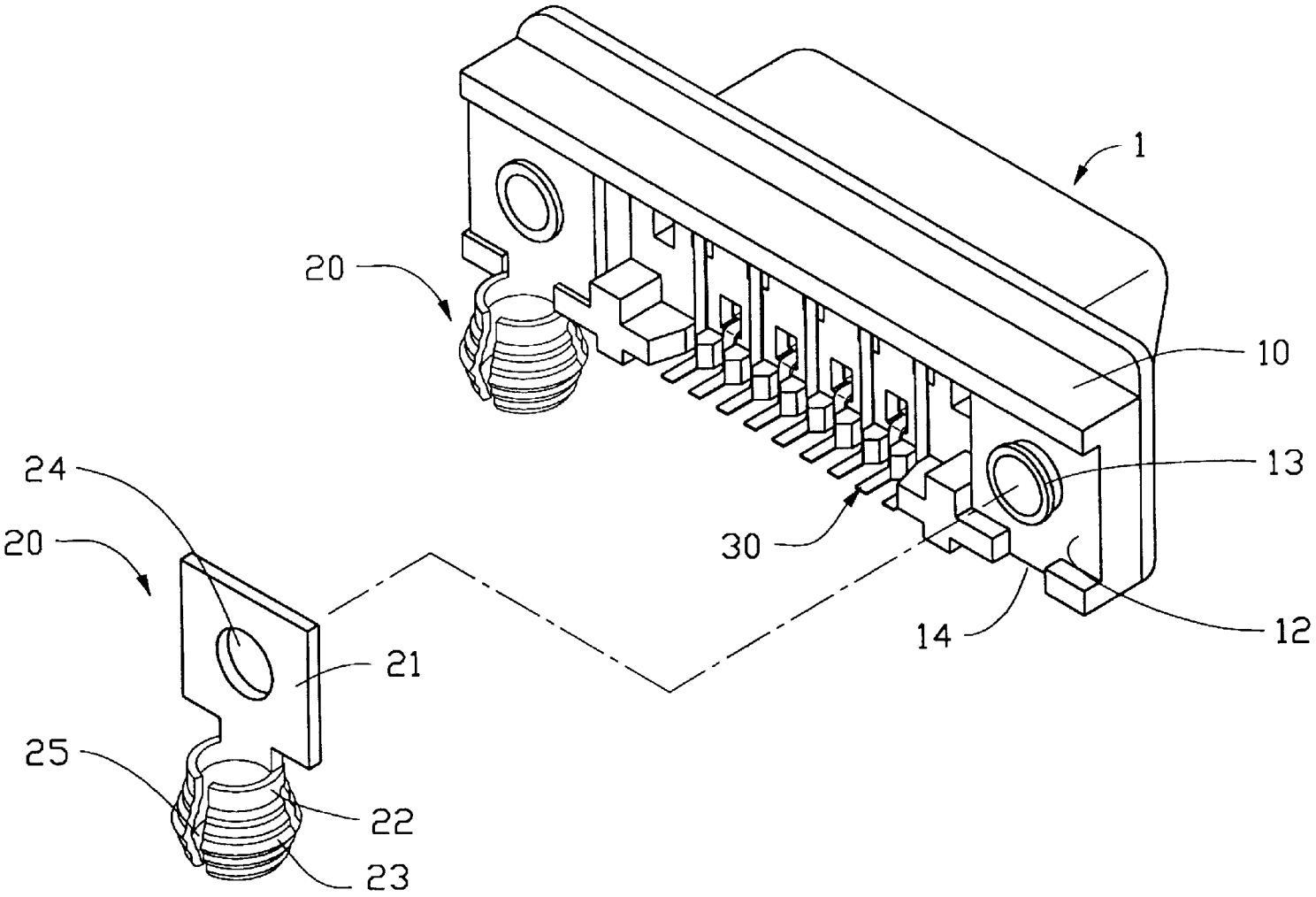
FIG. 2 is a perspective view of an electrical connector having two board locks constructed in accordance with the present invention mounted thereto.
Figure 4B:
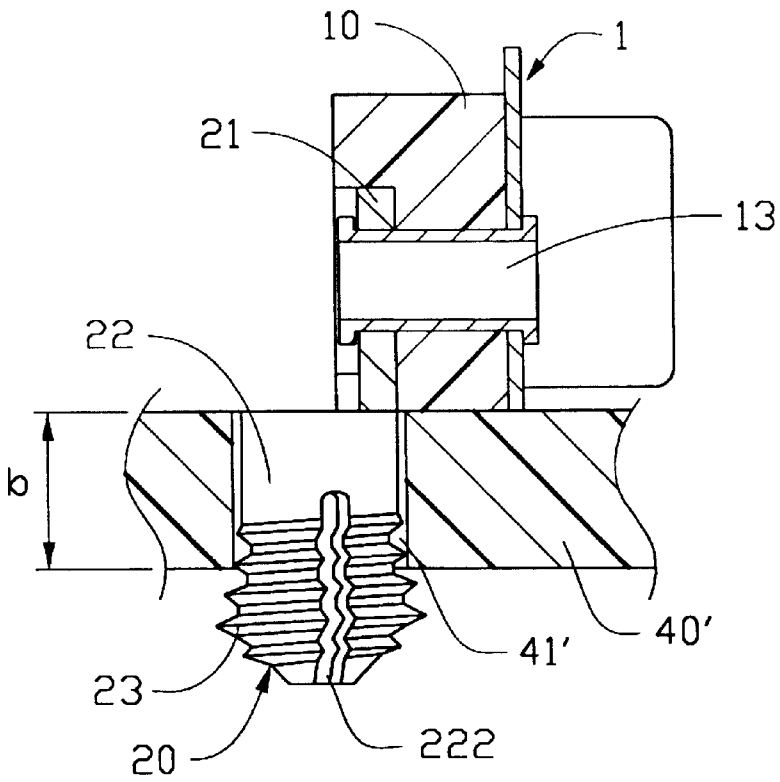
FIG 4B is a cross-sectional view of the electrical connector secured to a thin substrate by means of the board lock in accordance with the present invention.

Referring to the drawings and in particular to FIG. 2, a pair of board locks 20 constructed in accordance with the present invention are used to secure an electrical connector 1 to a circuit board 40 (FIG. 4A) or 40' (FIG. 4B). The connector 1 comprises an insulative casing 10 having a plurality of conductive terminals 30 received and fixed therein for electrical connection with a mating device (not shown). The casing 10 defines a recessed section 12 in opposite ends thereof for fixedly receiving the board lock 20 therein respectively.

Figure 3C:
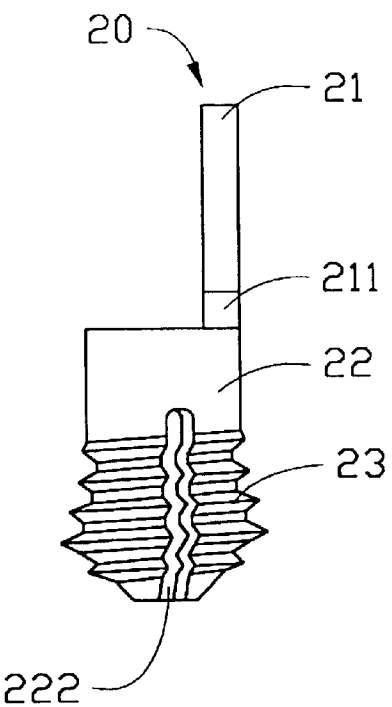
FIG. 3C is a side elevational view of the board lock of the present invention.
Figure 3B:
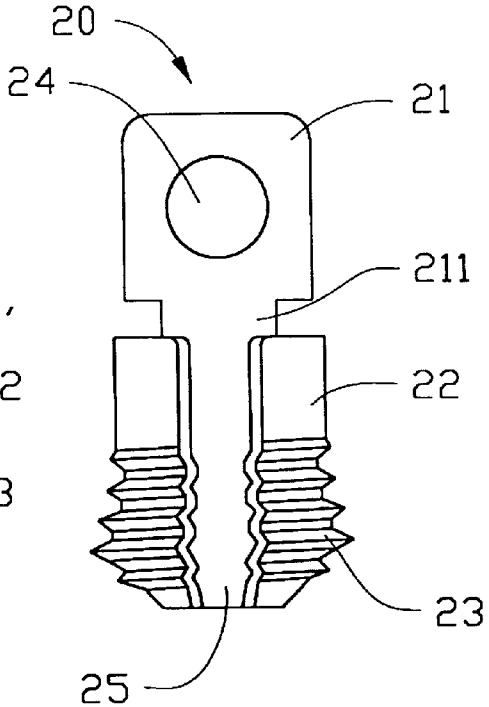
FIG. 3B is a front view of the board lock of the present invention.
Figure 3A:
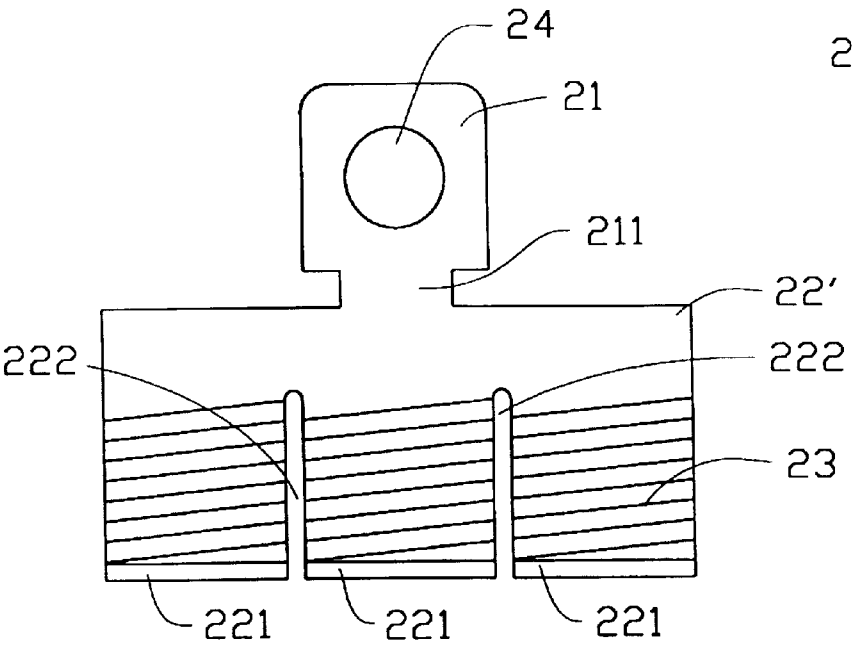
FIG. 3A is a developed view of the board lock of the present invention.

Further referring to FIGS. 3A–3C, the board lock 20 of the present invention comprises a plate-like base section 21 from which a barrel-like section 22 extends. The base section 21 is received in the corresponding recessed section 12 of the casing 10 of the connector 1. The base section 21 defines a central hole 24 through which a fastener 13 extends. The fastener 13 is fixed to the casing 10 thereby securing the board lock 20 to the casing 10 of the connector 1.

As shown in FIG. 3A, the barrel section 22 is preferably constructed by forming a flat plate 22' into a cylinder. The plate 22' is preferably connected to the base section 21 by a neck 211. Threading 23 may be formed on the plate 22' by a stamping procedure.

The plate 22' defines a plurality of slits 222 substantially parallel to each other. The cylinder defines a gap 25 (FIG. 3B) between two opposite edges of the plate 22'. Therefore, the barrel section 22 constructed from the plate 22' comprises a plurality of axially-extending slits 222 which are circumferentially spaced. The slits 222 and the gap 25 divide the barrel section 22 into several resilient segments 221 (FIG. 3A) each having a portion of the threading 23 formed thereon.

Preferably, the cylinder constructed from the plate 22' forms a central outward convex portion having an increased diameter.

Referring back to FIG. 2, the recessed section 12 of the connector 1 may be provided with a notch 14 for receiving the neck 211*n* of he board lock 20.

Figure 4A:
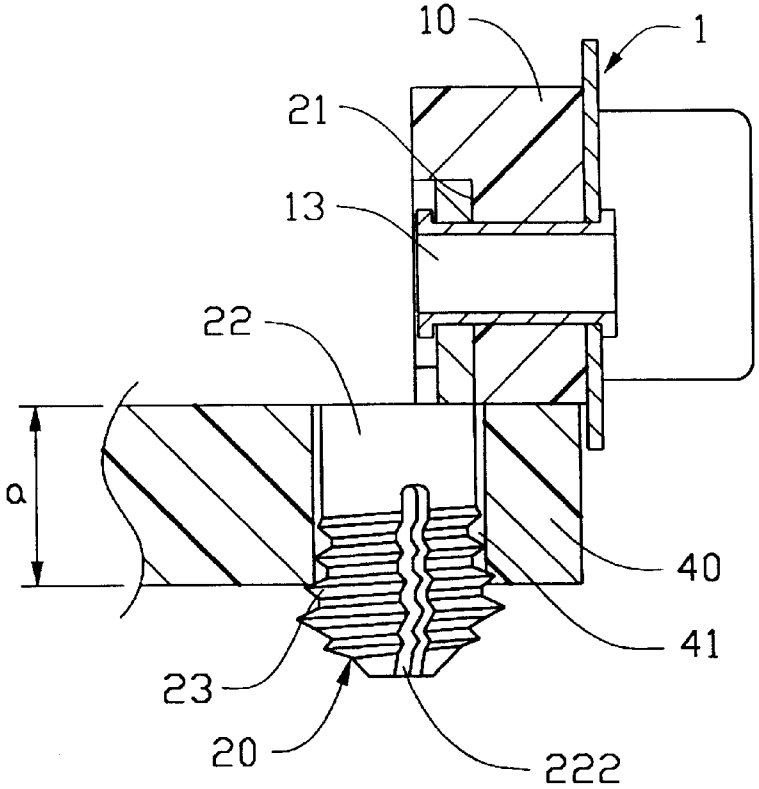
FIG. 4A is a cross-sectional view of an electrical connector secured to a substrate by means of the board lock in accordance with the present invention.

Due to the provision of the slits 222 and the gap 25, the segments 221 of the barrel section 22 are contractible when acted upon by a radial force thereby reducing the diameter of the barrel section 22. The contracted condition of the barrel section 22 allows the barrel section 22 to be readily fit into a hole 41 defined in a substrate 40 having a specific thickness "a" (FIG. 4A). The resiliency of the segments 221 of the barrel section 22 generates a spring-back force which causes the barrel section 22 to resume its original diameter upon removal of the radial force. The threading 23 may be arranged to engage with an inner surface of the hole 41 and a bottom surface of the substrate 40 to secure the connector 1 to the substrate 40.

It is understood that the central convex portion of the barrel section 22 allows a portion of the threading 23 to engage with a bottom surface of the substrate 40 thereby enhancing the securement of the connector 1 to the substrate 40.

FIG. 4B shows that the board lock 20 secures a connector 1 to a substrate 40' of a smaller thickness "b". The barrel section 22 is fit into a hole 41' and engages with the substrate 40'. Due to the convex portion of the barrel section 22, the threading 23 engages with an inner surface of the hole 41' and a bottom surface of the substrate 40' to securely fix the connector 1 to the substrate 40'.

It can be noted that because the invention provides a line/circumferential engagement between the board lock 20 and the substrate 40 instead of the traditional two opposite points engagement, the securement effect can be increased. By the way, in the invention through some proper arrangement of the lead angle and the pitch of the thread, and the angle of the convex portion of the barrel section 20, the threading 23 may engage both the inner surface of the hole 41 and the bottom surface of the substrate 40 to generate two directional retention forces, i.e., the horizontal lateral force derived from the engagement upon the inner surface of the hole and the vertical force derived from the engagement upon the bottom surface of the substrate around the hole.

It should be noted that although an electrical connector is taken as an example to explain the present invention, the application of the present invention is not limited to the connector. The board lock of the present invention may be used to secure other devices or articles to a substrate.

Although the present invention has been described with reference to a preferred embodiment thereof, it is apparent to those skilled in the art that a variety of modifications and changes may be made without departing from the scope of the present invention which is intended to be defined by the appended claims.

What is claimed is:

1. A board lock adapted to mount an electrical device to a substrate defining a hole of a predetermined inner diameter, comprising a base section adapted to be fixed to the electrical device and an elastically diameter-contractible barrel section extending from the base section beyond a face of the electrical device, the barrel comprising an external threading, the barrel having a section of nominal diameter substantially equal to or greater than the inner diameter of the hole whereby the barrel is elastically contractible to be inserted into the hole which generates a spring-back force driving the external threading to engage with an inner surface of the hole, thereby securing the electrical device to the substrate.

2. The board lock as claimed in claim 1, wherein the barrel section has a plurality of axially defined slits thereby dividing the barrel section into circumferentially spaced resilient segments.

3. The board lock as claimed in claim 1, wherein the barrel section comprises a central portion having an outwardly expanded, convex configuration whereby at least a portion of the threading of the central portion engages with a bottom surface of the substrate.

4. The board lock as claimed in claim 1, wherein the base section comprises a plate member defining a bore therein, through which bore a fastener extends for securing the board lock to the electrical device.

5. An electrical connection device comprising:

a connector adapted to be positioned on a substrate, the substrate defining at least one hole therein, the hole having a predetermined inner diameter; and at least one board lock, comprising a base section fixed to the electrical connection device and an elastically diameter-contractible barrel section extending from the base section beyond a bottom face of the electrical connection device, the barrel comprising an external threading and having at least one section of nominal diameter substantially equal to or greater than the inner diameter of the hole whereby the barrel is elastically contractible to be inserted into the hole which generates a spring-back force driving the external threading to engage with an inner surface of the hole thereby securing the electrical connection device to the substrate.

6. The electrical connection device as claimed in claim 5, wherein the barrel section has a plurality of axially defined slits thereby dividing the barrel section into circumferentially spaced resilient segments.

7. The electrical connection device as claimed in claim 5, wherein the barrel section comprises a central portion having an outwardly expanded, convex configuration whereby at least a portion of the threading of the central portion engages with a bottom surface of the substrate.

8. The electrical connection device as claimed in claim 5, wherein the base section comprises a plate member defining a bore therein, through which bore a fastener extends for securing the board lock to the connector.

9. A connector assembly comprising:

a connector including a board lock secured thereto;

a substrate positioned under the connector, said substrate defining a hole; and said board lock including external treading for providing a lateral force and an upward force to retain the connector in position on the substrate when said board lock is inserted into the hole.

10. The assembly as claimed in claim 9, wherein said external treading engages both an inner surface of the hole and a bottom surface of the substrate.

* * * * *